US011105024B2

(12) United States Patent
Tsujimoto

(10) Patent No.: US 11,105,024 B2
(45) Date of Patent: Aug. 31, 2021

(54) WEAVING METHOD EMPLOYED BY MULTICOLOR WATER JET LOOM

(71) Applicant: KABUSHIKI KAISHA TOYOTA JIDOSHOKKI, Kariya (JP)

(72) Inventor: Koichi Tsujimoto, Aichi-ken (JP)

(73) Assignee: KABUSHIKI KAISHA TOYOTA JIDOSHOKKI, Kariya (JP)

( * ) Notice: Subject to any disclaimer, the term of this patent is extended or adjusted under 35 U.S.C. 154(b) by 109 days.

(21) Appl. No.: 16/218,869

(22) Filed: Dec. 13, 2018

(65) Prior Publication Data

US 2019/0186060 A1 Jun. 20, 2019

(30) Foreign Application Priority Data

Dec. 15, 2017 (JP) ..... JP2017-240494

(51) Int. Cl.
*D03D 47/32* (2006.01)
*D03D 15/54* (2021.01)
*D03D 47/36* (2006.01)

(52) U.S. Cl.
CPC ..... *D03D 47/32* (2013.01); *D03D 15/54* (2021.01); *D03D 47/362* (2013.01); *D03D 2700/1495* (2013.01)

(58) Field of Classification Search
CPC .. D03D 47/32; D03D 15/0033; D03D 47/362; D03D 2700/1495
See application file for complete search history.

(56) References Cited

U.S. PATENT DOCUMENTS 3,828,829 A * 8/1974 Gotoh ..... D03D 47/00 139/435.2
4,087,213 A * 5/1978 Hadama ..... F04B 53/164 417/454
4,121,626 A * 10/1978 Brown ..... D03D 47/32 139/435.1
4,192,355 A * 3/1980 Peeler ..... D03D 47/3013 139/192
4,326,565 A * 4/1982 Van Mullekom .. D03D 47/3046 139/435.4

(Continued)

FOREIGN PATENT DOCUMENTS

JP 63-270841 A 11/1988
JP 1-168941 A 7/1989

(Continued)

*Primary Examiner* — Khoa D Huynh
*Assistant Examiner* — Erick I Lopez
(74) *Attorney, Agent, or Firm* — Sughrue Mion, PLLC

(57) ABSTRACT

A multicolor water-jet loom has a first nozzle and a second nozzle, a water supply unit for supplying water to the first and second nozzles, length-measuring devices for storing wefts, locking pins for locking the wefts stored in the length-measuring devices, and grippers for gripping the wefts drawn out from the length-measuring devices. The water supply unit executes an operation to supply one of the first and second nozzles that has been paused for at least a predetermined period with preparatory water only for a preparatory water supply period, the preparatory water supply period including a point one pick before weft insertion is executed by the nozzle that has been paused for at least the predetermined period, in a state where the wefts are locked by the locking pins and gripped by the grippers.

4 Claims, 5 Drawing Sheets

(56) References Cited

U.S. PATENT DOCUMENTS

| | | | | | |
|---|---|---|---|---|---|
| 4,529,017 | A | * | 7/1985 | Suzuki | D03D 47/367 139/452 |
| 4,550,754 | A | * | 11/1985 | Iida | D03D 47/362 139/452 |
| 4,590,972 | A | * | 5/1986 | Sugita | D03D 47/3033 139/435.2 |
| 4,625,770 | A | * | 12/1986 | Ishikawa | D03D 47/302 139/336 |
| 4,644,980 | A | * | 2/1987 | Mitsuya | D03D 47/3013 139/435.4 |
| 4,722,370 | A | * | 2/1988 | Manders | D03D 47/3033 139/429 |
| 9,382,648 | B2 | * | 7/2016 | Gielen | D03D 47/3053 |
| 2019/0233987 | A1 | * | 8/2019 | Yamauchi | D03D 47/32 |

FOREIGN PATENT DOCUMENTS

| | | | | |
|---|---|---|---|---|
| JP | 0625943 | A | * | 7/1992 |
| JP | 625943 | A | | 2/1994 |
| JP | 06025943 | A | * | 2/1994 |
| JP | 2003-313753 | A | | 11/2003 |
| JP | 2006070410 | A | | 3/2006 |

* cited by examiner

WEAVING METHOD EMPLOYED BY MULTICOLOR WATER JET LOOM

BACKGROUND OF THE INVENTION FIELD OF THE INVENTION

The present invention relates to a weaving method employed by a multicolor water-jet loom.

DESCRIPTION OF THE RELATED ART

A multicolor water-jet loom is a water-jet loom that can weave weft of two or more colors into a woven fabric and includes a plurality of weft insertion nozzles corresponding to the number of colors of the weft. By controlling a changeover valve or a stop valve provided in a water supply flow passage, the weft insertion nozzle corresponding to the color of the weft to be inserted is selected as appropriate and water is supplied thereto.

Depending on the design of the woven fabric, however, bias occurs among the colors of the weft to be woven. Hence, a weft insertion nozzle corresponding to a specific color may be out of action or paused for a long time. In such cases, water may disappear from the interior of a weft insertion nozzle that has been paused for a predetermined period or longer, and air bubbles may enter the interior of the weft insertion nozzle. As a result, when weft is inserted using a weft insertion nozzle that has been paused for a long time, the amount of ejected water may be insufficient, or the conveying force of the inserted weft may decrease due to air bubbles in the interior of the nozzle.

Therefore, in a water-jet loom described in Japanese Patent Application Publication No. 2003-313753, the amount of water in the weft insertion nozzle is prevented from becoming insufficient and air bubbles are prevented from becoming intermixed in the interior of the weft insertion nozzle by supplying a part of pressurized water that is discharged to the outside to an paused weft insertion nozzle.

In the multicolor water-jet loom according to Japanese Patent Application Publication No. 2003-313753, however, water is supplied constantly to both the operative weft insertion nozzle and the paused weft insertion nozzle, and therefore a problem occurs in that the amount of water used increases, leading to increases in water charges and waste water treatment costs. Moreover, a dedicated changeover valve is provided in a water supply pipe, and therefore the changeover valve must be replaced with a normal valve whenever it is not necessary to supply water to the paused weft insertion nozzle, leading to a further cost increase.

The present invention has been designed to solve these problems, and an object thereof is to provide a weaving method employed by a multicolor water-jet loom, with which a reduction in the inserted weft conveying force of a weft insertion nozzle that has been paused for at least a predetermined period can be prevented at low cost.

To solve the problems described above, a weaving method according to the present invention is employed by a multicolor water-jet loom having at least two weft insertion nozzles, a water supply unit for supplying water to the weft insertion nozzles, length-measuring devices for respectively storing wefts ejected respectively from the weft insertion nozzles, locking pins for locking the wefts stored in the respective length-measuring devices, and grippers for gripping the wefts drawn out from the respective length-measuring devices, and includes providing a preparatory water supply period for a weft insertion nozzle that has been paused for at least a predetermined period, the preparatory water supply period being provided within the period for which the weft insertion nozzle is paused and being set to include at least a point one pick before weft insertion is executed by the weft insertion nozzle and to be shorter than the period for which the weft insertion nozzle has been paused, and having the water supply unit execute an operation to supply the weft insertion nozzle that has been paused for at least the predetermined period with preparatory water only for the preparatory water supply period in a state where the weft is locked by the locking pin and gripped by the gripper.

DESCRIPTION OF THE PREFERRED EMBODIMENTS

An embodiment of the present invention will be described below on the basis of the attached figures.

Figure 1:
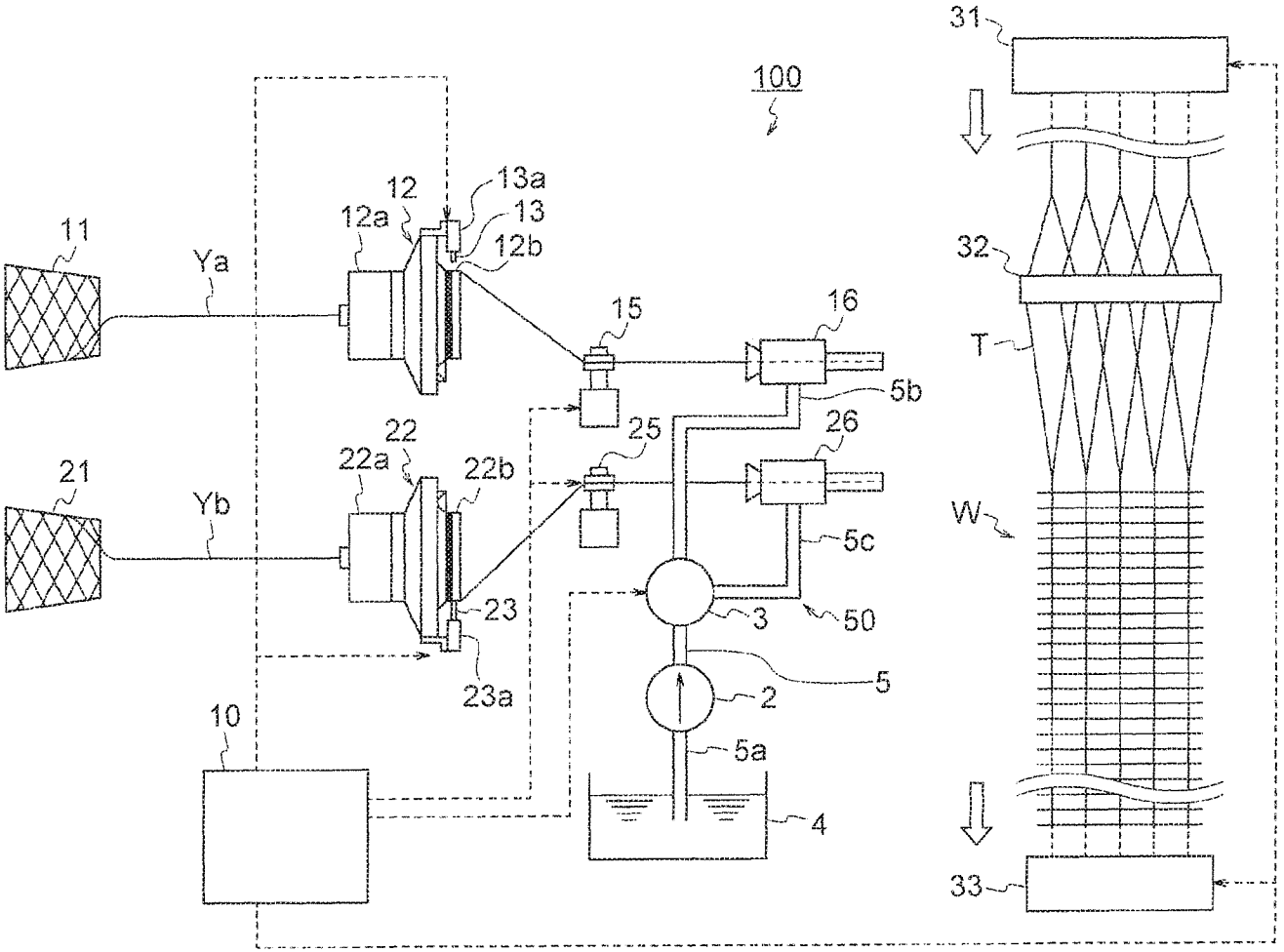
FIG. 1 is a schematic view of a multicolor water-jet loom according to an embodiment of the present invention.

A multicolor water-jet loom 100 shown in FIG. 1 executes weaving using wefts Ya, Yb of two different colors. Here, the color of the weft Ya is set as a color A and the color of the weft Yb is set as a color B. The multicolor water-jet loom 100 includes a first nozzle 16 serving as a weft insertion nozzle that ejects the weft Ya, and a second nozzle 26 serving as a weft insertion nozzle that ejects the weft Yb.

The multicolor water-jet loom 100 also includes a first weft cheese 11 and a second weft cheese 21. The weft Ya of the color A is wound around the first weft cheese 11 and the weft Yb of the color B is wound around the second weft cheese 21. Further, the wefts Ya, Yb drawn out from the first and second weft cheeses 11, 21 are respectively wound around and stored on drums 12*b*, 22*b* of length-measuring devices 12, 22. Respective winding arms (not shown) of the length-measuring devices 12, 22 are driven to rotate by winding motors 12*a*, 22*a*. Further, the length-measuring devices 12, 22 are respectively provided with locking pins 13, 23. The locking pins 13, 23 are driven by electromagnetic solenoids 13*a*, 23*a*. The wefts Ya, Yb stored on the length-measuring devices 12, 22 are locked by driving the locking pins 13, 23 to project from the drums 12*b*, 22*b* of the length-measuring devices 12, 22. As a result, drawing out of the wefts Ya, Yb is restricted. Further, grippers 15, 25 are provided respectively between the length-measuring devices 12, 22 and the first and second nozzles 16, 26. Parts of the wefts Ya, Yb drawn out from the length-measuring devices 12, 22 are gripped respectively by the grippers 15, 25.

Furthermore, a water supply unit 50 is connected to the first and second nozzles 16, 26. The water supply unit 50 is a mechanism for supplying water to the first and second nozzles 16, 26 from a water tank 4 provided in the interior of the multicolor water-jet loom 100. The water supply unit 50 includes a water supply pipe 5 through which water flows. Further, the water supply pipe 5 includes an intake pipe 5*a* that communicates with the interior of the water tank 4, and first and second nozzle water supply pipe portions 5*b*, 5*c* that bifurcate from the intake pipe 5*a* and communicate respectively with the first and second nozzles 16, 26. A pump 2 is provided in the intake pipe 5*a*. Further, a changeover valve 3 is provided at a bifurcation point between the first nozzle water supply pipe portion 5*b* and the second nozzle water supply pipe portion 5*c*. In other words, the water supply unit 50 includes the pump 2, the intake pipe 5*a*, the first nozzle water supply pipe portion 5*b*, the second nozzle water supply pipe portion 5*c*, and the changeover valve 3.

The multicolor water-jet loom 100 further includes a feeding device 31 for feeding warp T, and a winding device 33 for winding up a completed woven fabric W. Furthermore, a shedding device 32 for shedding the warp T is provided between the feeding device 31 and the winding device 33.

Note that the pump 2 and the shedding device 32 are driven by a main motor (not shown) and are mechanically interlocked so as to operate synchronously. In other words, every time the pump 2 supplies water to the first nozzle 16 or the second nozzle 26, the shedding device 32 sheds the warp T in accordance with the weaving pattern of the woven fabric W.

Further, a control device 10 is electrically connected to the electromagnetic solenoids 13*a*, 23*a* of the length-measuring devices 12, 22, the grippers 15, 25, the changeover valve 3, the feeding device 31, and the winding device 33.

Next, a weaving method employed by the multicolor water-jet loom 100 will be described.

When the weft Ya of the color A is to be inserted, normally, the control device 10 controls the electromagnetic solenoid 13*a* to separate the locking pin 13 from the length-measuring device 12, and releases the grip of the gripper 15 on the weft Ya. Then, by supplying the water that is fed by the pump 2 to the first nozzle 16 through the first nozzle water supply pipe portion 5*b*, the weft Ya is ejected by a high-pressure water jet and inserted into the sheds in the warp T.

Similarly, when the weft Yb of the color B is to be inserted, the control device 10 controls the electromagnetic solenoid 23*a* to separate the locking pin 23 from the length-measuring device 22, and releases the grip of the gripper 25 on the weft Yb. Further, the changeover valve 3 is operated so that the water in the water tank 4 flows through the second nozzle water supply pipe portion 5*c*. Then, by supplying the water to the second nozzle 26 through the second nozzle water supply pipe portion 5*c*, the weft Yb is ejected by a high-pressure water jet and inserted into the sheds in the warp T.

Next, referring to FIGS. 2A and 2B, a weaving method employed by the multicolor water-jet loom 100 in order to create plain weave will be described in detail.

Once weft insertion in the color A has been implemented by the first nozzle 16 continuously for at least a predetermined period, the control device 10 causes water alone to be ejected from the second nozzle 26 at a timing including a point immediately before switching to weft insertion in the color B by the second nozzle 26. At this time, the weft Yb is not inserted from the second nozzle 26. This water, which is supplied in pick units to either the first nozzle 16 or the second nozzle 26 while weft insertion thereby is halted prior to switching the weft insertion color, will be referred to in the following description as "preparatory water". More specifically, before switching the weft color, in a state where the weft Yb is locked by the locking pin 23 and gripped by the gripper 25, the control device 10 controls the changeover valve 3 so that preparatory water is supplied to the second nozzle 26 through the second nozzle water supply pipe portion 5*c*. Hence, when water is fed from the pump 2 and the changeover valve 3 is switched, the water supply unit 50 executes an operation to supply preparatory water to the second nozzle 26 that has been paused for at least the predetermined period. At this time, the control device 10 halts feeding of the warp T and winding of the woven fabric W by temporarily halting the operations of the feeding device 31 and the winding device 33.

Here, the aforesaid "predetermined period" denotes a period corresponding to at least ten picks. Accordingly, the above wording "once weft insertion in the color A has been implemented continuously . . . for at least a predetermined period" means "once at least ten picks of weft in the color A have been inserted consecutively", or in other words "once the second nozzle 26 has been paused continuously for a period corresponding to at least ten picks".

Further, "immediately before" switching the weft insertion color means one pick before starting to insert weft in the color A or the color B.

Figure 2A:
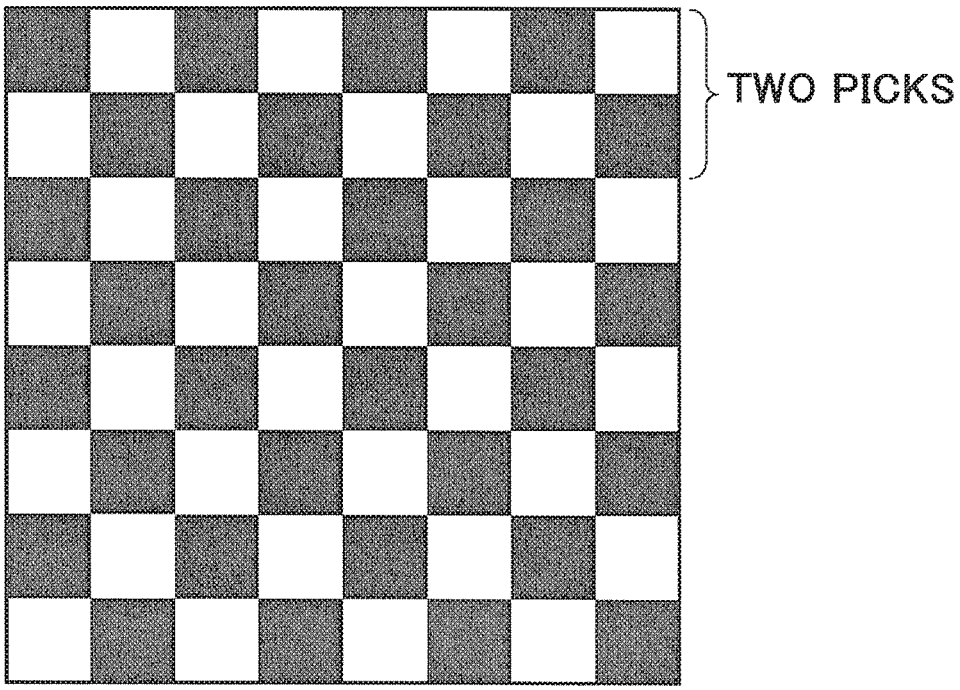
FIG. 2A is a weave diagram of a plain weave fabric.
Figure 2B:
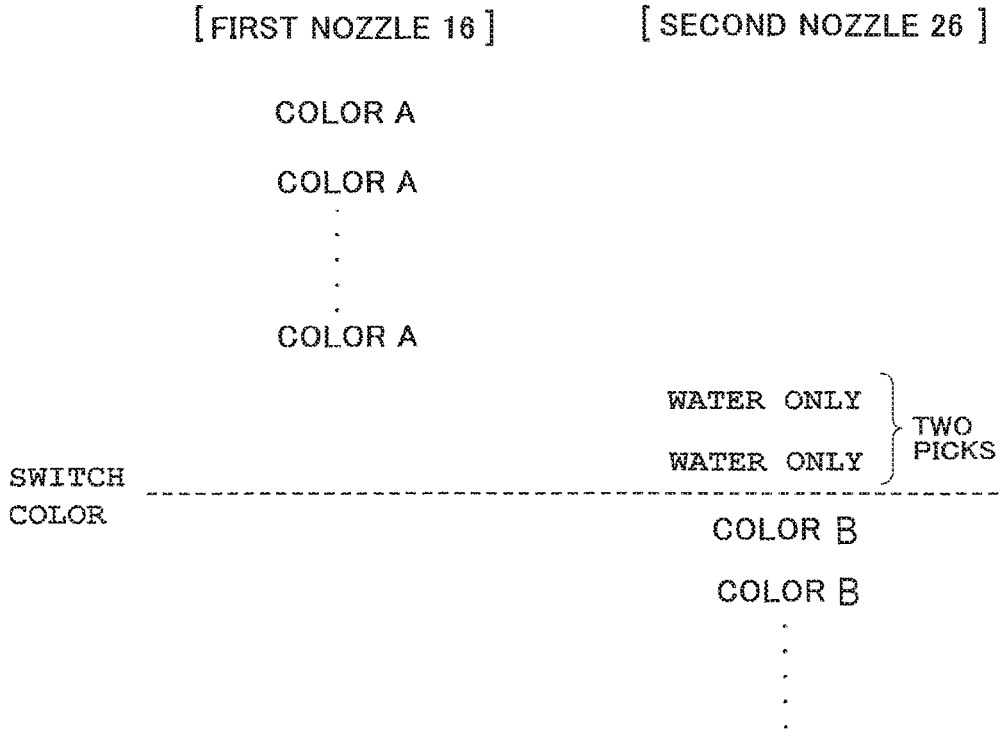
FIG. 2B is a table showing an example of weft insertion procedures of a weaving method employed when the multicolor water-jet loom shown in FIG. 1 creates the plain weave shown in FIG. 2A.

Note that when plain weave is created, as shown in FIG. 2A, the weft count of the complete weave of the woven fabric W, or in other words the repeat size of the weave, is two picks. As stated above, the pump 2 and the shedding device 32 operate synchronously, and therefore, every time the pump 2 feeds water toward the first nozzle 16 or the second nozzle 26 for a single pick, the shedding device 32 is also operated, leading to variation in the position of the warp T. As shown in FIG. 2B, therefore, to ensure that no deviations occur in the weave pattern of the woven fabric W, preparatory water is supplied to the second nozzle 26 twice corresponding to two picks before changing the weft insertion color, and the shedding device 3 is operated to return the position of the warp T to its original position.

Here, the period in which preparatory water is supplied to the first nozzle 16 or the second nozzle 26 after the nozzle has been paused for at least the predetermined period will be referred to as a "preparatory water supply period". The "preparatory water supply period" is set to include a point at least one pick before starting weft insertion in the color A or the color B and to be shorter than the period during which the nozzle to which the preparatory water is supplied has been paused. In the example shown in FIGS. 2A and 2B, therefore, the "preparatory water supply period" is a period extending for two picks before switching the weft insertion color from the color A to the color B.

Figure 3A:
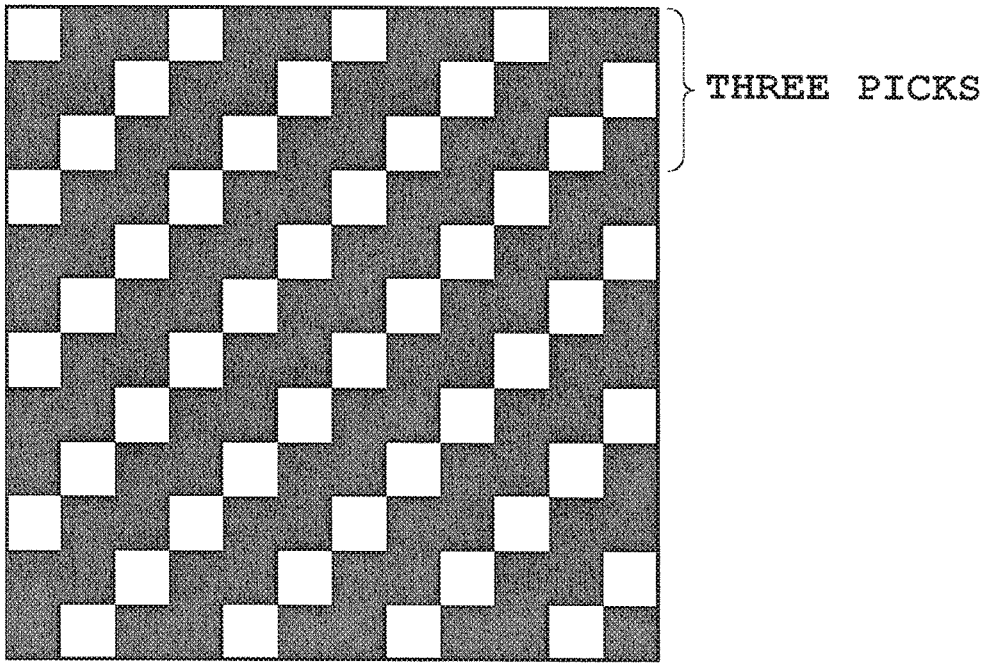
FIG. 3A is a weave diagram of a twill weave fabric.
Figure 3B:
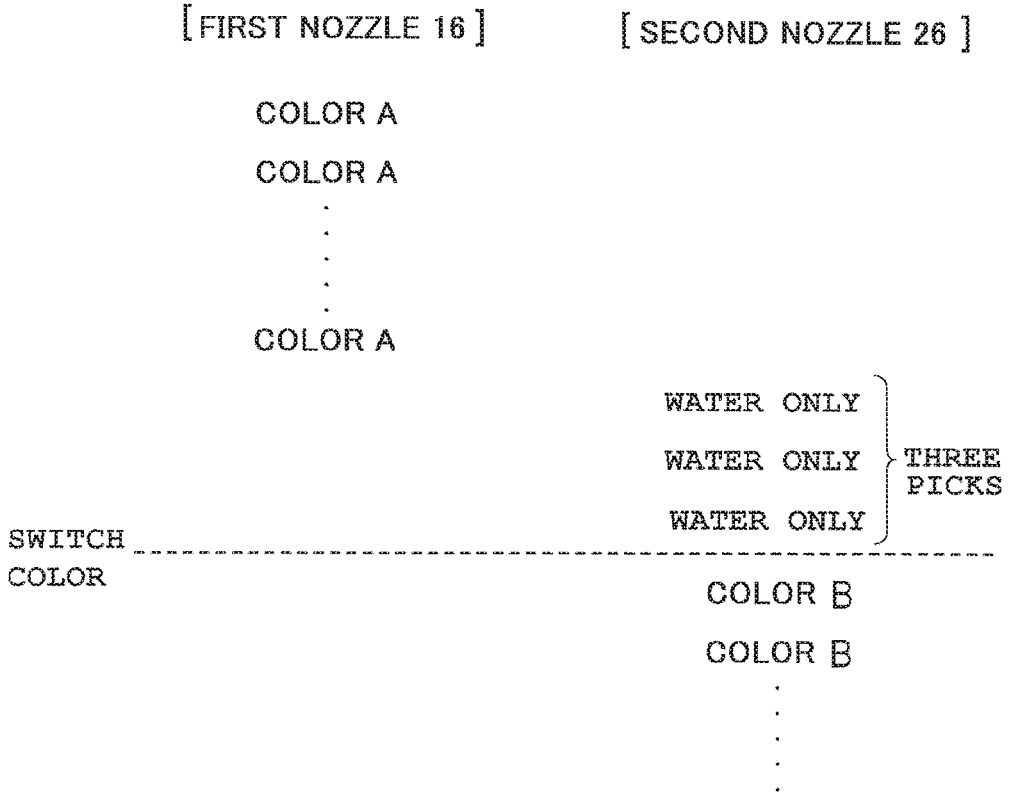
FIG. 3B is a table showing an example of weft insertion procedures of a weaving method employed when the multicolor water-jet loom shown in FIG. 1 creates the twill weave shown in FIG. 3A.

Further, when twill weave is created, as shown in FIG. 3A, the weft count of the complete weave of the woven fabric W is three picks. As shown in FIG. 3B, therefore, similarly to the case shown in FIGS. 2A and 2B, to ensure that no deviations occur in the weave pattern of the woven fabric W, preparatory water is supplied to the second nozzle 26 three times corresponding to three picks before changing the weft insertion color, and the shedding device 32 is operated. In other words, the preparatory water supply period for supplying preparatory water to the second nozzle 26 in this case is a period extending for three picks before switching the weft insertion color.

Note that the preparatory water supply period preferably extends for one to three picks before the weft insertion color is switched, but may extend for four or more picks before the weft insertion color is switched, depending on the weft count of the complete weave of the woven fabric W.

Moreover, once weft insertion in the color B has been implemented by the second nozzle 26 continuously for at least a predetermined number of picks, the control device 10 executes control to cause preparatory water to be ejected from the first nozzle 16 during the preparatory water supply period prior to switching the weft insertion color to the color A. It is assumed that during this period, the weft Ya is not inserted.

Hence, in the weaving method employed by the multicolor water-jet loom 100 according to this embodiment, as described above, the first nozzle 16 and the second nozzle 26 are used as two weft insertion nozzles corresponding respectively to two colors. When the second nozzle 26, among the two nozzles, has been paused for at least the predetermined period, preparatory water is supplied to the second nozzle 26 only for the preparatory water supply period before weft insertion is executed by the second nozzle 26 in a state where the length-measuring device 22 is halted and the weft Yb is locked by the locking pin 23 and gripped by the gripper 25. Similarly, when the first nozzle 16 has been paused for at least the predetermined period, preparatory water is supplied to the first nozzle 16 only for the preparatory water supply period before weft insertion is executed by the first nozzle 16 in a state where the length-measuring device 12 is halted and the weft Ya is locked by the locking pin 13 and gripped by the gripper 15. Thus, when weft insertion is executed by a weft insertion nozzle that has been paused for at least the predetermined period, situations in which the amount of water ejected by the weft insertion nozzle is insufficient or air bubbles become intermixed in the interior of the weft insertion nozzle can be prevented, and as a result, a sufficient inserted weft conveying force can be secured. Moreover, a reduction in the inserted weft conveying force of the multicolor water-jet loom 100 can be prevented by the control executed by the control device 10 alone, and therefore the need to exchange the weft insertion nozzles for nozzles having a special shape can be eliminated, leading to a reduction in cost. Furthermore, the preparatory water need only be supplied to the weft insertion nozzle that has been paused for at least the predetermined period during the preparatory water supply period including a point one pick before switching the weft insertion color. The preparatory water supply period is also set to be shorter than the period during which the weft insertion nozzle to which the preparatory water is supplied has been paused. In comparison with the conventional method of supplying water constantly to the paused weft insertion nozzle, therefore, the amount of used water can be reduced.

Further, during the preparatory water supply period prior to executing weft insertion using the weft insertion nozzle that has been paused for at least the predetermined period, feeding of the warp T and winding of the woven fabric W are halted by temporarily halting the operations of the feeding device 31 and the winding device 33. In so doing, unevenness in the density of the wefts Ya, Yb in the length direction of the woven fabric W can be prevented.

Furthermore, when the shedding device 32 performs a shedding operation on the warp T in synchronization with the pump 2, preparatory water is supplied to the second nozzle 26, for example, which has been paused for at least the predetermined period, a number of times that correspond to the weft count of the complete weave of the woven fabric W in a state where the weft Yb is locked by the locking pin 23 and gripped by the gripper 25. In other words, when the woven fabric W is a plain weave fabric, as shown in FIG. 2A, preparatory water is supplied to the second nozzle 26 twice corresponding to two picks. Further, when the woven fabric W is a twill weave fabric, as shown in FIG. 3A, preparatory water is supplied to the second nozzle 26 three times corresponding to three picks. Moreover, the timing at which the water supply unit 50 supplies water to the second nozzle 26 corresponds to the preparatory water supply period including a point one pick before weft insertion is executed by the second nozzle 26. Hence, situations in which the amount of water ejected by the second nozzle 26 that has been paused for at least the predetermined period is insufficient or air bubbles become intermixed therein can be prevented, and a situation in which a deviation occurs in the weave pattern when the weft insertion color is switched from the color A to the color B can be avoided.

Note that similar control is executed when the first nozzle 16 has been paused for at least the predetermined period.

The present invention is not limited to the embodiment described above, and in the case of a woven fabric in which a certain degree of unevenness in density is permissible, the feeding device 31 and the winding device 33 need not be halted when preparatory water is supplied to the weft insertion nozzle.

Further, in a case where the pump 2 and the shedding device 32 are electrified so as to be capable of operating independently, the shedding device 32 can be halted at a timing one pick before weft insertion is executed by the weft insertion nozzle that has been paused for at least the predetermined period. In this case, therefore, preparatory water need only be supplied once to the weft insertion nozzle that has been paused for at least the predetermined period, regardless of the weave pattern of the woven fabric W.

Furthermore, during the preparatory water supply period for supplying preparatory water to the weft insertion nozzle that has been paused for at least the predetermined period, preparatory water may be supplied even while the other weft insertion nozzle is operative.

Moreover, the supply source for the water supplied to the weft insertion nozzles is not limited to the water tank 4, and another water source, such as tap water, may be used instead.

Further, in this embodiment, the multicolor water-jet loom 100 includes two weft insertion nozzles, namely the first nozzle 16 and the second nozzle 26, but the multicolor water-jet loom 100 is not limited thereto and may include three or more weft insertion nozzles in accordance with the number of weft insertion colors.

Furthermore, the pump 2 according to this embodiment causes a high-pressure water jet to be ejected from the first nozzle 16 and the second nozzle 26, but the pump 2 is not limited thereto and may be capable of adjusting the ejection pressure of the first and second nozzles 16, 26 as appropriate. Moreover, when a pump capable of varying the water-feeding pressure is used, the ejection pressure of the water ejected from the first and second nozzles 16, 26 may be adjusted to a lower pressure than normal to protect the warp T.

What is claimed is:

1. A weaving method employed by a multicolor water-jet loom having:

at least two weft insertion nozzles;

a water supply unit for supplying water to the at least two weft insertion nozzles;

length-measuring devices for respectively storing wefts ejected respectively from the at least two weft insertion nozzles;

locking pins for locking the wefts stored in the respective length-measuring devices; and grippers for gripping the wefts drawn out from the respective length-measuring devices, the weaving method comprising:

providing a preparatory water supply period for the weft insertion nozzle having a pausing period that weft insertion has been paused continuously for at least ten picks, the preparatory water supply period including at least a point one pick before a weft insertion period which a weft insertion is executed by the weft insertion nozzle and including the number of pick which is less than the pausing period, the preparatory water supply period being provided within the pausing period, and having the water supply unit execute an operation to supply the weft insertion nozzle only for the preparatory water supply period in a state where the weft is locked by the locking pin and gripped by the gripper.

2. The weaving method employed by a multicolor water-jet loom according to claim 1, wherein, during the preparatory water supply period, warp feeding and woven fabric winding are stopped.

3. The weaving method employed by a multicolor water-jet loom according to claim 1, wherein, when the multicolor water-jet loom includes a shedding device for executing a warp-shedding operation in synchronization with a pump provided in the water supply unit, the water supply unit executes the operation to supply the weft insertion nozzle that has been paused for at least the period of at least ten picks with the preparatory water a number of times that correspond to a weft count of a complete weave of the woven fabric during the preparatory water supply period in the state where the weft is locked by the locking pin of the length-measuring device and gripped by the gripper.

4. The weaving method employed by a multicolor water-jet loom according to claim 2, wherein, when the multicolor water-jet loom includes a shedding device for executing a warp-shedding operation in synchronization with a pump provided in the water supply unit, the water supply unit executes the operation to supply the weft insertion nozzle that has been paused for at least the period of at least ten picks with the preparatory water a number of times that correspond to a weft count of a complete weave of the woven fabric during the preparatory water supply period in the state where the weft is locked by the locking pin of the length-measuring device and gripped by the gripper.

* * * * *